US008535754B2

(12) United States Patent
Huang

(10) Patent No.: US 8,535,754 B2
(45) Date of Patent: Sep. 17, 2013

(54) METHOD OF PROCESSING A TREADMILL BELT AND AN APPARATUS FOR PRACTICING THE METHOD

(75) Inventor: Ching-Yang Huang, Ta Ya Hsiang (TW)

(73) Assignee: Johnson Health Tech Co., Ltd., Taichung Hsien (TW)

( * ) Notice: Subject to any disclaimer, the term of this patent is extended or adjusted under 35 U.S.C. 154(b) by 270 days.

(21) Appl. No.: 12/957,243

(22) Filed: Nov. 30, 2010

(65) Prior Publication Data

US 2012/0135139 A1 May 31, 2012

(51) Int. Cl.
*B05D 1/12* (2006.01)

(52) U.S. Cl.
USPC ..... 427/180; 427/369; 427/370; 427/195

(58) Field of Classification Search
USPC ..... 427/180, 369, 370, 267; 482/51, 482/54; 474/256, 267; 198/846, 847, 850, 198/853
See application file for complete search history.

(56) References Cited

U.S. PATENT DOCUMENTS 3,503,777 A * 3/1970 Kappas et al. ..... 428/96
5,433,679 A * 7/1995 Szymczak et al. ..... 482/54
5,597,092 A * 1/1997 Havlovitz ..... 222/45

FOREIGN PATENT DOCUMENTS

TW M257848 3/2005

* cited by examiner

*Primary Examiner* — Frederick Parker
*Assistant Examiner* — Ann Disarro

(57) ABSTRACT

A method for enhancing anti-abrasion of a belt of a treadmill and an apparatus for practicing the method are disclosed herein. As processing the belt, the belt is installed in the apparatus and a driving device of the apparatus can move the belt. A distributing device of the apparatus scatters solid lubricative material on the surface of the belt. As the belt being moved, the lubricative material is melted by a heating device of the apparatus. When the belt is moved to leave the heating device, the melted lubricative material coagulates and engages with the surface of the belt.

7 Claims, 5 Drawing Sheets

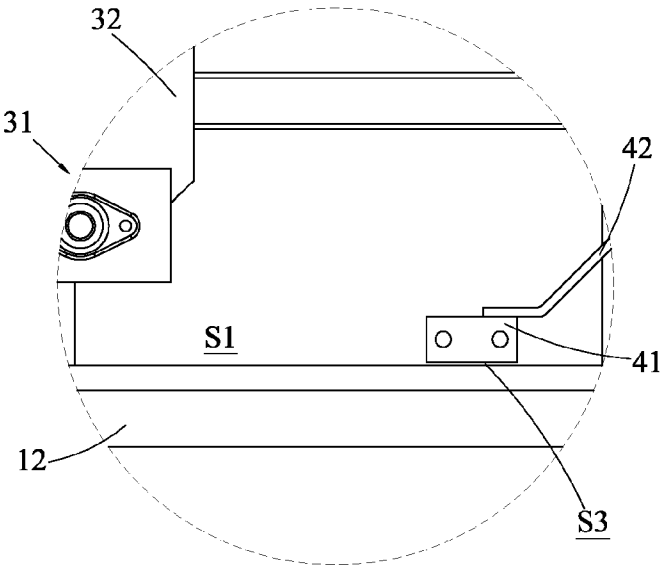
FIG. 2-b
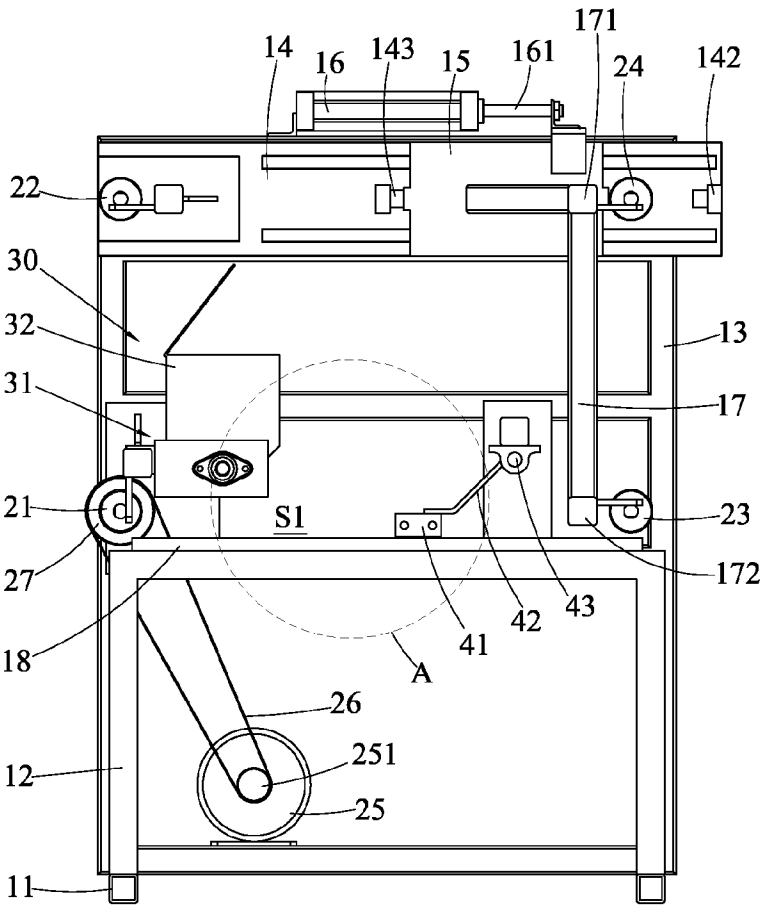
FIG. 2-a

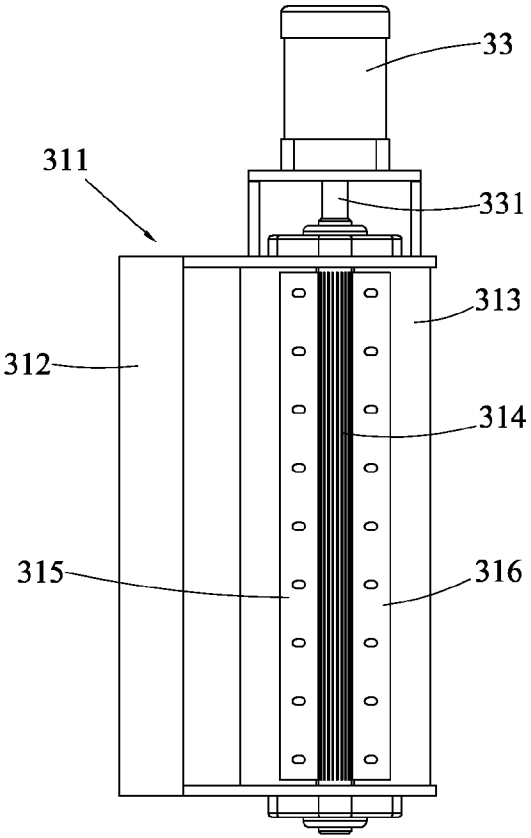
FIG. 3-b
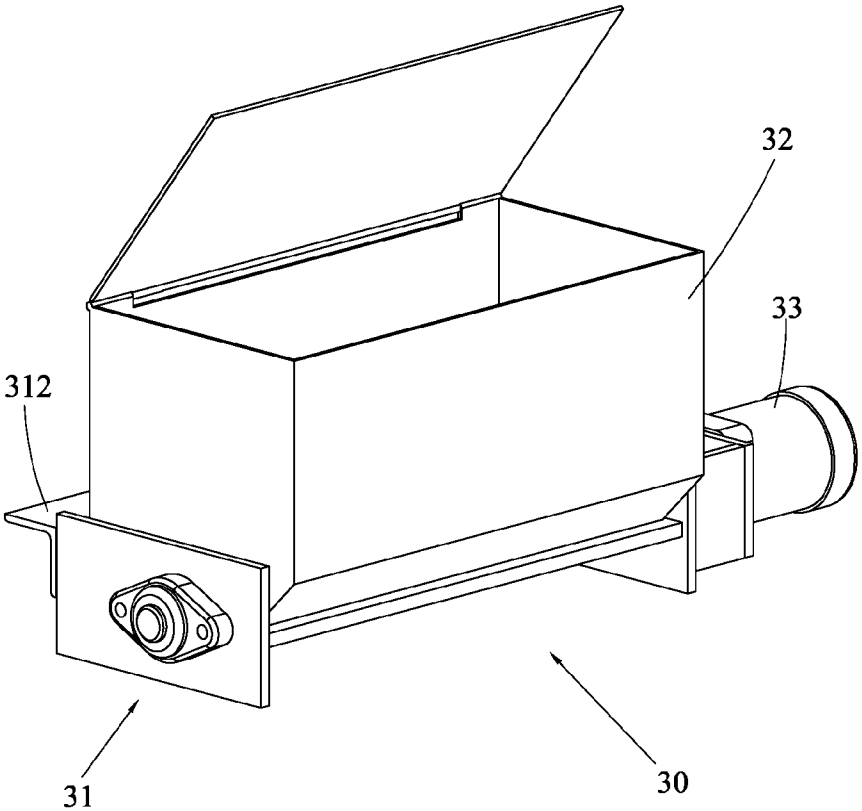
FIG. 3-a

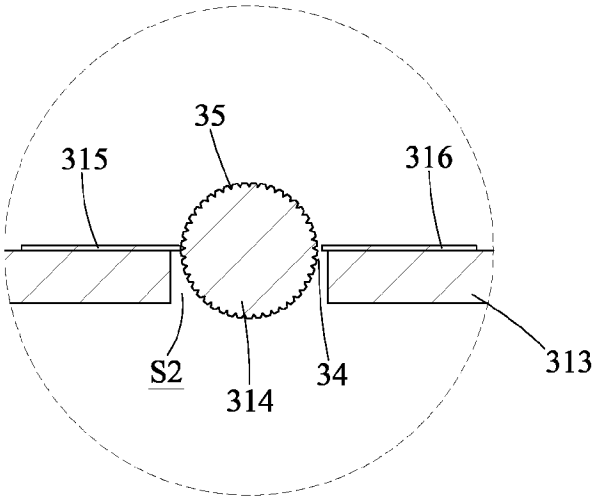
FIG. 3-e
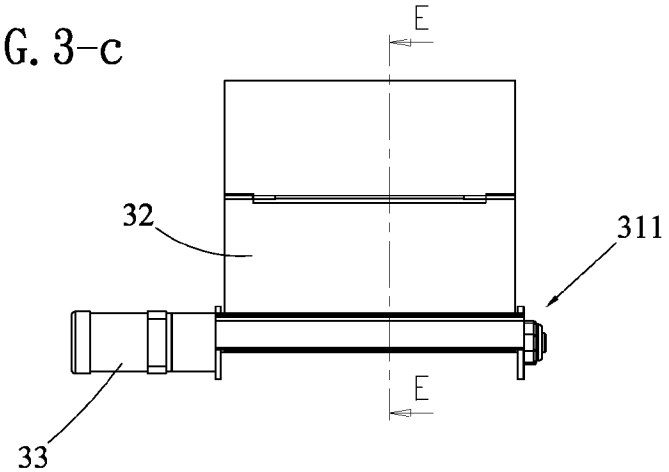
FIG. 3-c
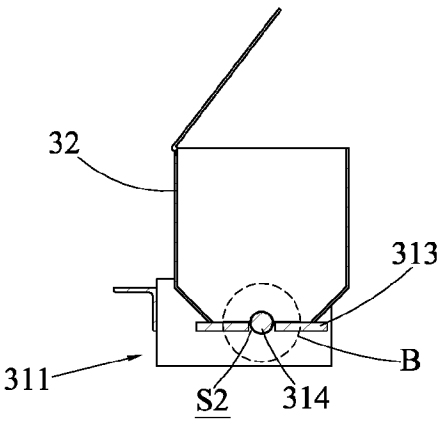
FIG. 3-d

METHOD OF PROCESSING A TREADMILL BELT AND AN APPARATUS FOR PRACTICING THE METHOD

BACKGROUND

1. Field of the Invention

This invention relates to an exercise apparatus, and more particularly to a method and an apparatus for enhancing anti-abrasion of a surface of a belt used in a treadmill.

2. Description of the Related Art

Almost every treadmill uses an endless belt or equivalents, such as a track, for providing a user to run or jog in a little space. As known in the prior art, the endless belt rotates around two pulleys and encircled a supporting deck which is located between the pulleys for supporting the user. Because of the mechanical relationship, friction between an inner surface of the endless belt, a surface of the endless belt which faces to the surface of the supporting deck, and the supporting deck causing the endless belt wear has become a serious problem. In order to lessen the wear situation, an endless belt is usually manufactured by particular endurable materials for making the inner surface thereof have a characteristic of anti-abrasion. Prior to finally assembly of a treadmill, some treadmill manufacturers further process lubricative treatments for the treadmill in order to extend the service life. There are several known processes, such as manually rub or dispersing lubricant as a treadmill operating time, to make lubricative material, such as liquefied wax, or lubricative oil, attach on a surface of a supporting deck. However, these processes can not provide a solution for a treadmill manufacture to solve a problem of how to control an amount of lubricative material to provide significant degree of lubrication without bringing redundant lubricative material in a treadmill which results in ill effects to the treadmill.

For example, one of the processing methods is to coat a surface of a supporting deck with a lubricative layer. When a user exercises on a treadmill, the use's foot impacts an endless belt of the treadmill and causes an inner surface of the endless belt intermittently presses a supporting deck of the treadmill, temporally causing the endless belt to rub against the supporting deck. That produces some lubricative dust which is scraped from the lubricative layer by the inner surface of the endless belt. The lubricative dust randomly attaches on the inner surface of the endless belt to decrease belt to deck friction. Further explanation, a belt for a treadmill is usually made by stacking several layers of different materials. An inner surface of the belt which is designed to rub against a supporting deck is weaved by particular fibers. Therefore, there are many small concaves existing in between longitudinal fibers and lateral fibers. The inner surface of the belt substantially is a rough surface in micro view. When the impact occurs, the inner surface of an endless belt scrapes a trace of lubricative dust and part of the lubricative dust is carried by the small concaves. Nevertheless, this processing method can not make all lubricative dust attach on the inner surface of the endless belt. Some free lubricative dust which drops on other components of the treadmill will cause some problems. In particular, when front and rear rollers of the treadmill are covered too much lubricative dust, there is noise as the treadmill running. Another problem is that although a trace of lubricative dust is enough to effectively reduce the belt to deck friction, the deck still need to be covered an extra thicker lubricative layer which contains more lubricative material than actual need. The reason is that a treadmill manufacturer can not make sure or control how much lubricative dust will attach on the inner surface of the belt. In order to extend lubricative time and increase the lubricative dust attaching probability, it is necessary to make each rub between the endless belt and supporting deck scrapes enough lubricative dust. Therefore, the lubricative layer become thicker and the manufacturing cost arises.

TW M257848 patent illustrates another processing method which is directly applied liquefied wax to an inner surface of an endless belt. It discloses a machine which has a roller configured to stain with liquefied wax in advance and then smear it over the inner surface of the endless belt. The machine uses a scraper to controlling the amount of liquefied wax stained on the peripheral surface of the roller. Therefore, the inner surface of the endless belt is uniformly covered by a layer of liquefied wax. After cooling and solidification, a solid lubricative layer is formed on the endless belt. However, this processing method has some problems. As aforementioned, an inner surface of an endless belt is a rough surface in micro view. The roller of the machine can not control a proper amount of the liquefied wax to flow into the concaves of the inner surface of the endless belt. By this processing method, both the concaves and fibers are covered by the lubricative layer. In detail, an endless belt is usually made by several non-absorbent materials. Liquefied lubricative material, such as the liquefied wax, can not penetrate into the endless belt. The liquefied lubricative material which does not flow into the concaves heaps up on the surfaces of the fibers and solidifies to become a layer. The combining relationship between the layer and the endless belt is weak because the contact area therebetween is relatively small comparing to those in the concaves. When the endless belt is fabricated to a treadmill and a user start to exercise thereon, the lubricative layer is easily detached from the inner surface of the endless belt. Therefore, it causes the aforementioned noise problem. Besides, the lubricative material also has a possibility leaking out of the treadmill and pollution. Therefore, the endless belt may cover too much lubricative wax even this processing method uses a scraper mechanism.

SUMMARY

An object of the present invention is to provide a method for processing belt lubrication for an exercise apparatus, such as a treadmill, and an apparatus for practicing the method which engages solid lubricative material with a surface of the belt to enhance anti-abrasion. Lubrication between the processed belt and a supporting desk is durable. The processing method is economic.

In a preferred embodiment of the invention, a method of enhancing anti-abrasion of a belt used in a treadmill comprises steps of: providing the belt and moving the belt from an inlet of a processing zone to an outlet of a processing zone; storing powdery lubricative material in a storage portion of a distributing device; controlling the distributing device to make the powdery lubricative material scatter on the surface of the belt from a releasing portion of the distributing device located; controlling the belt to move through a space which is heated by a heating device and located closer to the outlet than the releasing portion, the space is heated to melted the powdery lubricative material in a liquid state and capable for maintaining the liquid state in a short time; moving the belt out of the space of the heating device.

In the preferred embodiment, an apparatus is provided to practice the method. The apparatus comprises: a frame has a processing zone, the processing zone having an inlet and an outlet; a driving device coupled to the frame; a distributing device coupled to the frame having a storage portion and a releasing portion which is located above the processing zone;

and a heating device coupled to the frame having a space and a heating portion, the space located closer to the outlet of the processing zone than the releasing portion of the distributing device. The space can be heated by the heating portion of the heating device.

BRIEF DESCRIPTION OF THE DRAWINGS

FIG. 2-*a* is a front view of the embodiment of FIG. 1;

FIG. 2-*b* is an enlarged view of the "area A" in FIG. 2-*a;*

FIG. 3-*a* is a perspective view of a distributing device of the embodiment of FIG. 1;

FIG. 3-*b* is a top view of FIG. 3-*a* without a storage portion of the distributing device;

FIG. 3-*c* is a left view of the distributing device of FIG. 3-*a;*

FIG. 3-*d* is a cutaway view about the E-E axis in FIG. 3-*c;*

FIG. 3-*e* is an enlarged view of the "area B" in FIG. 3-*d*; and

DETAIL DESCRIPTION

Figure 1:
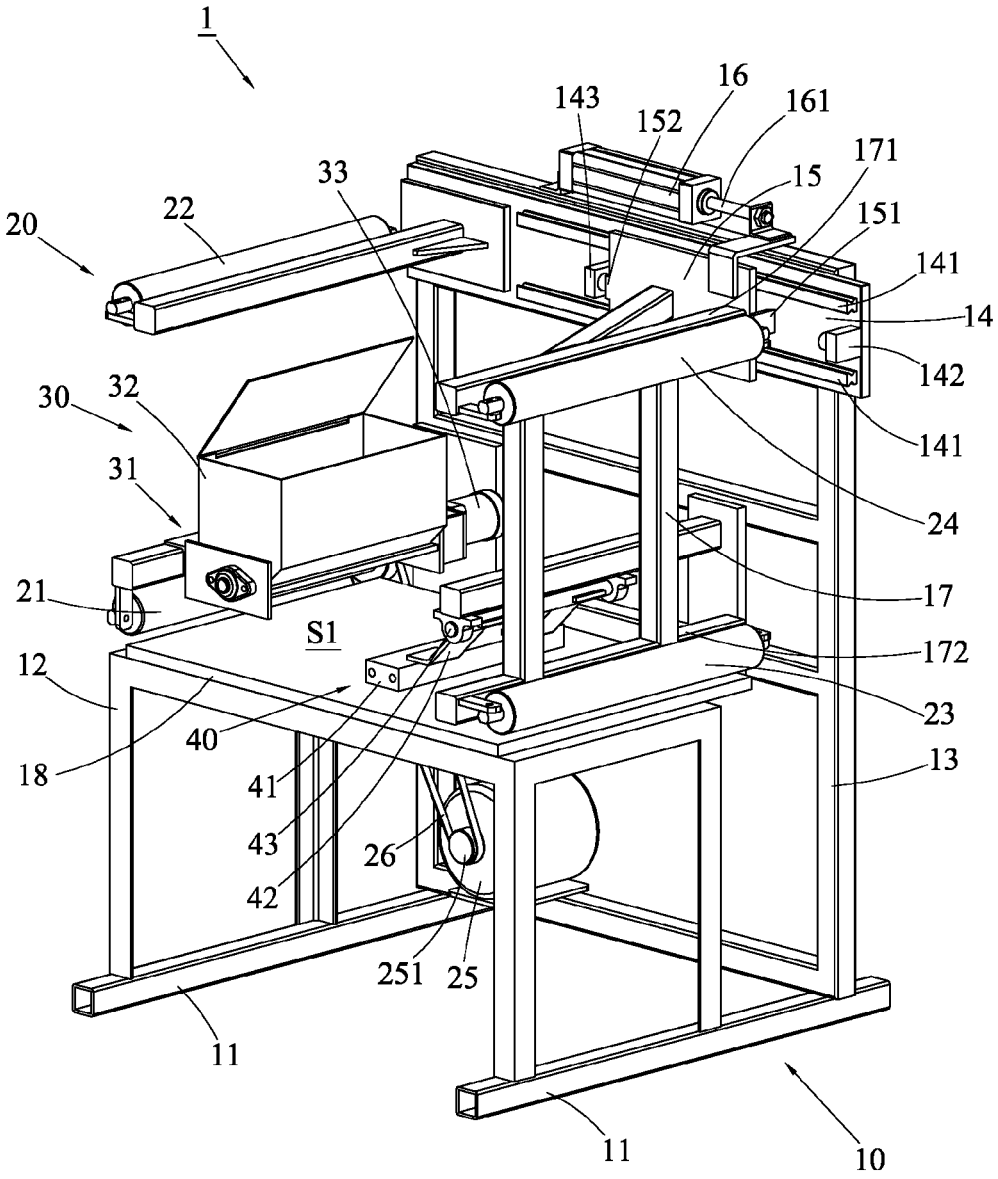
FIG. 1 is a perspective view of an embodiment of the present invention.

Referring now specifically to the figures, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims.

Referring to FIG. 1, in an embodiment, the invention provides an apparatus 1 that includes a frame 10, a control system (not shown), a driving device 20 mounted on the frame 10, a distributing device 30 coupled to the frame 10 near a central portion thereof, and a heating device 40 located near the distributing device 30 coupled to the frame 10.

Figure 4:
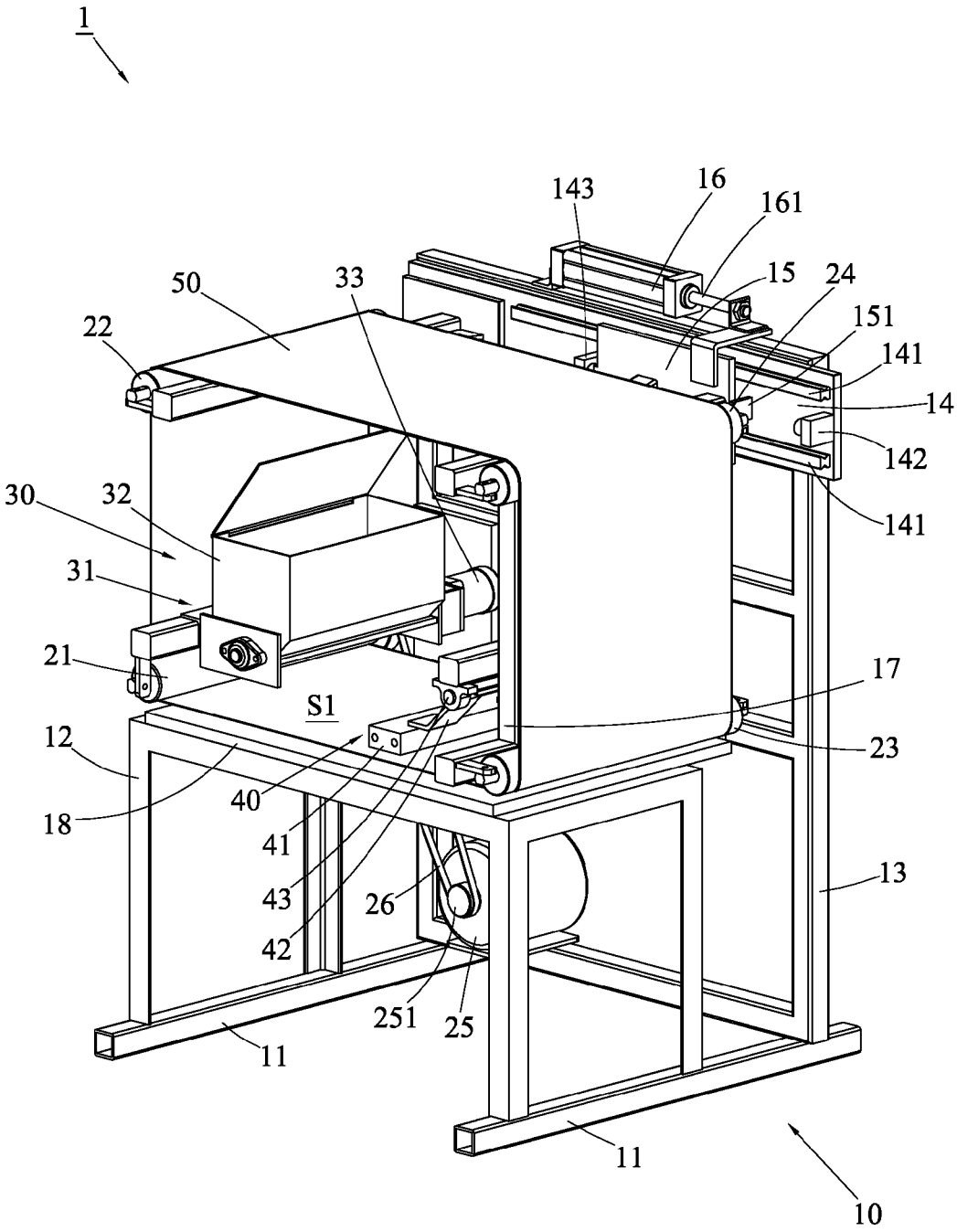
FIG. 4 is a perspective view of the embodiment of FIG. 1 which shows a state as processing an endless belt.

The frame 10 is adapted to stablely rest on the ground. The frame 10 includes two paralleled supporting bars 11 supported on the ground, a working table 12 mounted on front portions of the supporting bars 11, a pad unit 18 mounted on the working table 12, and a rack 13 behind the working table 12 mounted on rear portions of the supporting bars 11. A lateral processing zone S1 is designed and positioned above the working table 12. As shown in FIG. 4, when an endless belt 50 is fed from the left side of the apparatus 1, the endless belt 50 can be processed in the processing zone S1 by a processing method provided by the present invention. There is a supporting board 14 mounted on an upper portion of the rack 13. Two rails 141 are laterally mounted on the supporting board 14. Besides, left stopper 143 and right stoppers 142 are oppositely mounted on a central portion of the supporting board 14. There is a pneumatic cylinder 16 mounted on the top of the rack 13. The pneumatic cylinder 16 has a piston rod 161 which can be driven to move leftward or rightward. A moving plank 15 is engaged with the two rails 141 and mounted to the piston rod 161 of the pneumatic cylinder 16. When the piston rod 161 is driven to move rightward, the moving plank 15 is also driven to move rightward until a right block 151 of the moving plank 15 touches the right stopper 142. Likewise, when the piston rod 161 is driven to move leftward, the moving plank 15 is also driven to move leftward until a left block 152 of the moving plank 15 touches the left stopper 143. Furthermore, a bracket 17 which is shaped as "II" mounted to the moving blank 15 by an upper horizontal portion 171 thereof. When the pneumatic cylinder 16 controls the piston rod 161 to move, the bracket 17 is indirectly driven to move leftward or rightward relative to the working table 12.

The control system (not shown) is coupled to the frame 10 and used for making the driving device 20, distributing device 30, and heating device 40 automatic operation. The control system could be a known electric control system or automatic control system. Thus, details of the control system are regarded as prior art and should be appreciated by people skilled in the art.

Referring to FIGS. 1 and 2-*a*, the driving device 20 includes four rollers 21, 22, 23, 24 located above the working table 12 and a first motor 25 mounted on the frame 10. The rollers 21, 22, 23, 24 are: a first roller 21 located on the left side of the processing zone S1, a second roller 22 located above the first roller 21, a third roller 23 located on the right side of the processing zone S1, and a fourth roller 24 located above the third roller 23. All the rollers 21, 22, 23, 24 are disposed longitudinally as shown in FIG. 2-*a*. The first roller 21 is coupled to the frame 10 and the far distal end thereof is coaxially connected to a pulley 27. The pulley 27 is rotated by an axle 251 of the first motor 25 via a strap 26. The second roller 22 is also connected to the frame 10. The third and fourth rollers 23, 24 are respectively connected to a lower horizontal portion 172 and the higher horizontal portion 171 of the "II" shaped bracket 17. When the bracket 17 is moved, the third and fourth rollers 23, 24 are simultaneously moved relative to the frame 10.

Referring to FIGS. 1 and 3-*a* to 3-*e*, the distributing device 30 comprises an allotting mechanism 31 which is located above the processing zone 51 and coupled to the frame 10, left and right gap adjusting units 315, 316, and a storage portion 32 connected to the allotting mechanism 31. The allotting mechanism 31 includes a base 311, a rod 314, and a second motor 33. The base 311 of the allotting mechanism 31 has a bottom panel 313 and a connecting portion 312 mounted on the frame 10. There is a rectangular hole S2 which the width thereof is adjustable arranged in the central portion of the bottom panel 313. The long edge of the rectangular hole S2 is corresponding to fore-and-aft direction of the apparatus 10, i.e. parallels to the rollers 21, 22, 23, 24. The rod 314 is arranged in the rectangular hole S2 and pivoted to the base 311 in accordance with the fore-and-aft direction. Moreover, the peripheral surface of the rod 314 is covered with many grooves 35. The grooves 35 are parallel to the axial direction of the rod 314. In the embodiment, each of the grooves 35 has a V-shaped vertical section, however, it is not limited. The left and right gap adjusting units 315, 316 are respectively arranged beside the long edges of the rectangular hole S2. Each of the left and right gap adjusting units 315, 316 can be adjusted to move leftward or rightward in order to control the width of the rectangular hole S2. In other words, the left and right gap adjusting units 315, 316 can control gaps between the peripheral surface of the rod 314 and the long edges of the rectangular hole S2. Besides, the left and right gap adjusting units 315, 316 symbolically divided the peripheral surface of the rod 314 as an inner surface and an external surface. Referring to FIG. 3-*e*, the inner surface is part of the peripheral surface of the rod 314 higher than the left and right gap adjusting units 315, 316. The external surface is part of the peripheral surface of the rod 314 lower than the left and right gap adjusting units 315, 316. The second motor 33 is configured for rotating the rod 314 via the axle 331 thereof. When the rod 314 is rotated, one side of the peripheral surface thereof which is rotated downward and the corresponding long edge of the rectangular hole S2 form as a releasing portion 34, that is to say, a transition place as the inner surface of the rod 314 becoming the external surface of the rod 314 is the releasing portion 34. In other possible embodiment, if the distributing devise 30 does not have the left and right gap adjusting units 315, 316, the bottom panel 313 of the base 311 becomes the demarcation. The storage portion 32 is coupled to the bottom panel 313. The storage portion 32 has functions of a funnel and storage, so that the storage portion 32 can guide contents by gravity to the rectangular hole S2 of the bottom panel 313.

Referring to FIGS. 1, 2-*a*, and 2-*b*, the heating device 40 comprises a heating portion 41, a shaft 43, and two moveable arms 42. In the embodiment, the heating portion 41 is a metallic cuboid and the long side thereof is in accordance with the fore-and-aft direction. The heating portion 41 can be heated by energy, such as electrical power, thermal energy, or magnetic field. The shaft 43 is longitudinally coupled to the frame 10. Each of the movable arms 42 is interconnected between the heating portion 41 and the shaft 43. Referring to FIG. 2-*a*, when the shaft 43 is rotated clockwise, the movable arms 42 can lift the heating portion 41. When the shaft 43 is rotated counterclockwise, the movable arms 42 can push the heating portion 41 to press toward the working table 12. Besides, the heating device 40 further comprises a space S3. In the embodiment, the space S3 is beneath the heating portion 41. When the heating portion 41 is heated, temperature of the space S3 accordingly arises due to thermal conduction.

The processing method of the embodiment has steps. Firstly, putting solid lubricative material into the storage portion 32 of the distributing device 30. In the embodiment, the solid lubricative material had been powdered as lubricative powder and sifted so that each of particles substantially has the same size. Then, as shown in FIG. 4, an endless belt 50 is encircled the first 21, second 22, third 23, and fourth rollers 24 in a way of making an inner surface of the endless belt 50 face the processing zone S1. Right following engaging the endless belt 50 to the four rollers 21, 22, 23, 24, the pneumatic cylinder 16 is controlled to move the piston rod 161 rightward in order to make the four rollers 21, 22, 23, 24 stretch the endless belt 50. Controlling the heating device 40 to raise the temperature of the heating portion 41 to a degree, the heated heating portion 41 is capable of melting the lubricative powder. Starting the control system, the control system makes the second motor 33 drive the rod 314 of the distributing device 30 to rotate and then scatter the lubricative powder on the inner surface of the endless belt 50. The first motor 25 is simultaneously actuated by the control system to control the first roller 21 to rotate counterclockwise, so that the endless belt 50 is driven to move counterclockwise. When the endless belt 50 enters the processing zone S1 from an inlet of the processing zone S1 which is under the first roller 21, continuously moving through the space S3 of the heating device 40, and then moving to an outlet which is under the third roller 23, it means that part of the endless belt 50 has been processed by the method of the embodiment of the invention. In addition, locations of the inlet and outlet of the processing zone S1 depend on locations of the distributing device 30 and the space S3 of the heating device 40. For example, if the locations of the distributing device 30 and the space S3 of the embodiment are exchanged, the endless belt 50 needs to be correspondingly changed to move clockwise. Accordingly, the region under the third roller 23 becomes an inlet of the processing zone S1 and the region under the first roller 21 becomes an outlet of the processing zone S1.

Referring to FIGS. 3-*d* and 3-*e*, the rod 314 of the distributing device 30 is rotated clockwise by the second motor 33. The left gap adjusting unit 315 touches the peripheral surface of the rod 314. However, there is an interval between the right gap adjusting unit 316 and the peripheral surface of the rod 314. During the process of the grooves 35 crossing the interval, the grooves 35 can help the lubricative powder drop out of the releasing portion 34. In details, the lubricative powder is substantially not allowed to drop from the interval as the peripheral surface of the rod 314 facing the right gap adjusting unit 316 or as the rod is static. As shown in FIG. 3-*e*, the lubricative powder is not allowed to drop from the left side of the rod 314 because the left gap adjusting unit 315 substantially touches the rod 314, i.e. the left long edge of the rectangular hole S2 substantially contacts the rod 314. Therefore, density of the grooves 35 and rotating speed of the rod 314 of the distributing device 30 can control powder releasing frequency. If moving speed of the endless belt 50 is correspondingly adjusted, distribution of the lubricative powder on the inner surface of the endless belt 50 can also be controlled. In other possible embodiment, a distance between the releasing portion 34 and the endless belt 50 may be adjustable in order to control density of the lubricative powder. Moreover, the position of the left and right gap adjusting units can be freely adjusted depending on particle size of lubricative powder and manufacture's demand. In other possible embodiment, the releasing portion 34 may be controlled to open intermittently. Also, in a possible embodiment, a distributing device may not have a gap adjusting unit and a rod of the distributing device may not have grooves. One can adjust an interval between an edge of the rectangular hole and the rod in advance. Thus, lubricative powder can also be released by the rotation of the rod. Possibly, if particle size of the lubricative powder is small enough to fall into the grooves 35 of the rod 314, the left and right gap adjusting units 315, 314 can both be controlled to contact the peripheral surface of the rod 314. In sum, the distributing device 30 is a quantitative feeding device. Density of the lubricative powder in per unit area of the inner surface of the endless belt 50 can be substantially controlled by the embodiment.

Referring to FIGS. 2-*b*, 3-*e*, and 4, as shown in the figures, the endless belt 50 is moved from the inlet of the processing zone S1 (left side of FIG. 4) to the outlet of the processing zone 51 (right side of FIG. 4) and the inner surface thereof faces to the processing zone 51. When the endless belt 50 is driven to pass through the distributing device 30, the lubricative powder falls on the inner surface of the endless belt 50 at a predetermined frequency. As the endless belt 50 keeping moving, the lubricative powder enters into the space S3 of the heating device 40. Each of the powder particles in the space S3 is melted and becomes a liquefied lubricative drop. Because the function of the distributing device 30, per unit of area of the inner surface of the endless belt 50 only has a trace of liquefied lubricative drops. Each liquefied lubricative drop has more chances to flow into nearby concaves of the endless belt 50 and thereby reduce a probability that too many liquefied lubricative drops stay in the same concave. After the endless belt 50 being moved out of the space S3 of the heating device 40, liquefied lubricative drops are substantially coagulated in the concaves and engage with nearby longitudinal and lateral fibers of the inner surface of the endless belt 50 to form many lubricative areas on the surface of the belt. Furthermore, because the space S3 of the heating device 40 has a significant width, when the lubricative powder is moved into the space S3, the lubricative powder is heated continuously in a short time. Therefore, the liquefied lubricative drops are easily to flow into the concaves.

In the embodiment, the heating portion 41 is moved to make the bottom surface thereof contact the inner surface of the endless belt 50. Therefore, when the endless belt 50 is moved toward the space S3 of the heating device 40, the lubricative powder thereon starts to be melted as touching the front edge of the bottom surface of the heating portion 41. Some melted lubricative powder (liquefied lubricative drops) is forced to flow into the concaves by the heating portion 41 except some melted lubricative powder has already flowed into the concaves. Accordingly, because the bottom surface of the heating portion 41 has a significant width, the bottom surface of the heating portion 41 is capable of continuously forcing the liquefied lubricative drops flows into the concaves. Therefore, a phenomenon of coagulating the liquefied lubricative drops on the top surface of the fibers can be significantly diminished. In other possible embodiment, a front portion of a bottom panel of a heating device may be designed as a declined surface. Thus, when the heating portion contacts an inner surface of an endless belt, a space therebetween is a high-to-low space. This possible embodiment may be used when an inner surface of an endless belt is needed to be engaged with more lubricative powder.

Generally, in view of efficacy of modern lubricative powder, a trace of lubricative powder is enough to reach requirement of a treadmill. Thus, the above description shows that the processing method and apparatus of the invention can do quantitative control and remold the lubricative powder to engage with an inner surface of an endless belt to make the effect of lubrication more durable. Therefore, when a processed endless belt is fabricated to a treadmill and provides for a user to use, a treadmill manufacture does not need to frequently replenish lubricative material or replace an endless belt. The problem of redundant lubricative material can also be solved by the present invention.

The present invention does not require that all the advantageous features and all the advantages need to be incorporated into every embodiment thereof. Although the present invention has been described in considerable detail with reference to certain preferred embodiment thereof, other embodiments are possible. Therefore, the spirit and scope of the appended claims should not be limited to the description of the preferred embodiment contained herein.

What is claimed is:

1. A method of enhancing anti-abrasion of a surface of a belt used in a treadmill, the method comprising steps of:

controlling the belt to move from an inlet of a processing zone to an outlet of the processing zone;

controlling a distributing device to make solid lubricative material which is stored in a storage portion of the distributing device pass through a releasing portion of the distributing device to be scattered on the surface of the belt;

controlling a heating device to make a heating portion thereof to heat a space of the heating device which is positioned closer to the outlet of the processing zone than the releasing portion of the distributing device to a temperature of liquefying the solid lubricative material, wherein when the belt is moved into the space of the heating device, the solid lubricative material on the surface of the belt continuously being liquefied and forced by the heating portion to permeate into the surface; and moving the belt out of the space of the heating device to make the liquefied lubricative material coagulate to engage with the surface of the belt.

2. The method of enhancing anti-abrasion of a surface of a belt used in a treadmill of claim 1, wherein the step of controlling the distributing device includes storing powdery lubricative material and activating an allotting mechanism of the distributing device to control the releasing portion of the distributing device to release the lubricative powder at a predetermined frequency.

3. The method of enhancing anti-abrasion of a surface of a belt used in a treadmill of claim 2, wherein the step of controlling the distributing device includes controlling a rod of the allotting mechanism to take the powdery lubricative material out of the storage portion of the distributing device and release from the releasing portion of the distributing device.

4. The method of enhancing anti-abrasion of a surface of a belt used in a treadmill of claim 3, wherein the steps of controlling the rod of the allotting mechanism includes controlling the rod to rotate in a hole of the distributing device, the solid lubricative material passing through the releasing portion of the distributing device when a groove disposed on the peripheral surface of the rod is driven in a direction of toward the belt to cross an edge of the hole and substantially aligns the edge of the hole of the distributing device.

5. The method of enhancing anti-abrasion of a surface of a belt used in a treadmill of claim 1, wherein the heating portion is movably forced toward the surface of the belt to press the liquefied lubricative material into the surface of the belt.

6. The method of enhancing anti-abrasion of a surface of a belt used in a treadmill of claim 5, wherein the heating portion is connected to at least one movable arm pivoting to a frame.

7. The method of enhancing anti-abrasion of a surface of a belt used in a treadmill of claim 6, wherein the heating portion is a metallic cuboid.

* * * * *